US012644399B2

(12) United States Patent
Sugiyama et al.

(10) Patent No.: US 12,644,399 B2
(45) Date of Patent: Jun. 2, 2026

(54) VALVE OPENING AND CLOSING TIMING CONTROL DEVICE

(71) Applicant: AISIN CORPORATION, Kariya (JP)

(72) Inventors: Shuhei Sugiyama, Kariya (JP); Yoshiaki Yamakawa, Kariya (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 18/949,557

(22) Filed: Nov. 15, 2024

(65) Prior Publication Data

US 2025/0179946 A1 Jun. 5, 2025

(30) Foreign Application Priority Data

Dec. 4, 2023 (JP) ..... 2023-204494

(51) Int. Cl.
*F01L 1/344* (2006.01)
*F01L 1/352* (2006.01)

(52) U.S. Cl.
CPC ..... *F01L 1/3442* (2013.01); *F01L 1/352* (2013.01); *F01L 2250/02* (2013.01); *F01L 2250/04* (2013.01); *F01L 2820/032* (2013.01)

(58) Field of Classification Search
CPC ... F01L 1/344; F01L 1/34403; F01L 1/34406; F01L 1/34409; F01L 1/3442;
(Continued)

(56) References Cited

U.S. PATENT DOCUMENTS

2003/0121486 A1 7/2003 Komazawa et al.
2010/0241338 A1 9/2010 Busse et al.
(Continued)

FOREIGN PATENT DOCUMENTS

DE 10256992 A1 7/2003
DE 102007054547 A1 5/2009
(Continued)

OTHER PUBLICATIONS

Extended European Search Report issued on May 13, 2025, in corresponding European Patent Application No. 24215363.3. (9 pages).

*Primary Examiner* — Loren C Edwards
(74) *Attorney, Agent, or Firm* — BUCHANAN INGERSOLL & ROONEY PC

(57) ABSTRACT

A valve opening and closing timing control device includes a drive-side rotating body that rotates synchronously with a crankshaft of an internal combustion engine about a rotation axis, a driven-side rotating body that is disposed coaxially with the rotation axis and inside the drive-side rotating body, and rotates integrally with a camshaft for opening and closing a valve of the internal combustion engine, a phase adjustment mechanism that includes plural gears for reducing a driving rotational force of an electric motor and sets a relative rotational phase between the drive-side rotating body and the driven-side rotating body, a lubricating oil supply unit that supplies lubricating oil to the phase adjustment mechanism from outside, and an oil discharge control unit that performs oil discharge control of discharging lubricating oil by changing the relative rotational phase by driving the electric motor in accordance with stop control of stopping the internal combustion engine.

6 Claims, 8 Drawing Sheets

(58) Field of Classification Search
CPC ..... F01L 1/352; F01L 2001/3521; F01L 2001/3522; F01L 1/356; F01L 2820/032; F01L 2250/02; F01L 2250/04; F01K 31/043
See application file for complete search history.

(56) References Cited

U.S. PATENT DOCUMENTS

| | | | | |
|---|---|---|---|---|
| 2013/0118430 | A1 | 5/2013 | Moriya et al. | |
| 2020/0256219 | A1* | 8/2020 | Takahashi ..... | F02D 13/0219 |

FOREIGN PATENT DOCUMENTS

| | | | |
|---|---|---|---|
| EP | 4177451 | A1 | 5/2023 |
| JP | 2007056839 | A | 3/2007 |
| JP | 2018087564 | A | 6/2018 |

* cited by examiner

VALVE OPENING AND CLOSING TIMING CONTROL DEVICE

CROSS REFERENCE TO RELATED APPLICATIONS

This application is based on and claims priority under 35 U.S.C. § 119 to Japanese Patent Application No. 2023-204494, filed on Dec. 4, 2023, the entire content of which is incorporated herein by reference.

TECHNICAL FIELD

The present disclosure relates to a valve opening and closing timing control device.

BACKGROUND DISCUSSION

JP 2007-56839 A describes a valve opening and closing timing control device (a valve timing device in the literature) capable of setting a valve timing of an intake valve of an internal combustion engine by a driving force of an electric motor.

The valve opening and closing timing control device described in JP 2007-56839 A sets four temperature regions as temperature regions of an internal combustion engine (an engine in the literature), determines which of the four temperature regions the temperature of the internal combustion engine belongs to at the time of starting the internal combustion engine, and sets a target valve timing set for each temperature region.

In the internal combustion engine, when the temperature decreases, the viscosity of the engine oil is high, and the load at the time of cranking increases. Therefore, the load acting on the crankshaft in the intake stroke is reduced by performing control to set the valve timing of the valve opening and closing timing control device to the retard side as the temperature decreases.

JP 2018-87564 A describes a valve opening and closing timing control device that can set the timing by a driving force of an electric motor, as in JP 2007-56839 A.

The valve opening and closing timing control device described in JP 2018-87564 A includes a drive-side rotating body, a driven-side rotating body, a gear-type phase adjustment mechanism, a phase control motor that drives the phase adjustment mechanism, an Oldham's coupling, a front plate, and the like.

In a valve opening and closing timing control device described in JP 2018-87564 A, the driven-side rotating body is accommodated in the drive-side rotating body, and a phase adjustment mechanism is configured as a hypocyclo-type reduction mechanism so as to relatively rotate the drive-side rotating body and the driven-side rotating body by a driving force of a phase control motor.

Further, the valve opening and closing timing control device is configured to discharge the lubricating oil remaining inside when the internal combustion engine is stopped from the guide groove of the outer case or the opening of the front plate.

In starting an internal combustion engine in an extremely low-temperature environment, it is possible to use a technique described in JP 2007-56839 A for coping with a viscous friction problem at the time of starting due to an increase in viscosity of engine oil.

However, when the lubricating oil remains in the valve opening and closing timing control device at the time of starting the internal combustion engine in a low-temperature environment, it is difficult to set the valve timing by the control of the valve opening and closing timing control device immediately after the start of the internal combustion engine, and it takes time to set the valve timing.

In view of such a disadvantage, as described in JP 2018-87564 A, it is also conceivable to discharge the lubricating oil inside the valve opening and closing timing control device from the groove or the opening. However, even with such a configuration, the lubricating oil may not be sufficiently discharged, and the valve timing may not be quickly set by the valve opening and closing timing control device when the internal combustion engine is started in a low-temperature environment.

A need this exists for a valve opening and closing timing control device that can properly set the valve timing when the internal combustion engine is started at a low temperature.

SUMMARY

A configuration of a valve opening and closing timing control device according to the present disclosure includes a drive-side rotating body that rotates synchronously with a crankshaft of an internal combustion engine about a rotation axis, a driven-side rotating body that is disposed coaxially with the rotation axis and inside the drive-side rotating body, and rotates integrally with a camshaft for opening and closing a valve of the internal combustion engine, a phase adjustment mechanism that includes a plurality of gears for reducing a driving rotational force of an electric motor and sets a relative rotational phase between the drive-side rotating body and the driven-side rotating body, a lubricating oil supply unit that supplies lubricating oil to the phase adjustment mechanism from an outside, and an oil discharge control unit that performs oil discharge control of discharging lubricating oil by changing the relative rotational phase by driving the electric motor in accordance with stop control of stopping the internal combustion engine.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment of a valve opening and closing timing control device 100 according to the present disclosure will be described with reference to the drawings. In the present embodiment, as an example of a phase adjustment mechanism C, a configuration is described in which an output gear 25 having an annular internal tooth portion 25A and an input gear 30 having an annular external tooth portion 30A so as to be engaged with part of the output gear 25 are provided, and these are driven by a phase control motor M (electric motor) outside a drive-side rotating body A. However, the valve opening and closing timing control device 100 is not limited to the following embodiment, and various modifications can be made without departing from the gist of the embodiment.

Basic Configuration

Figure 1:
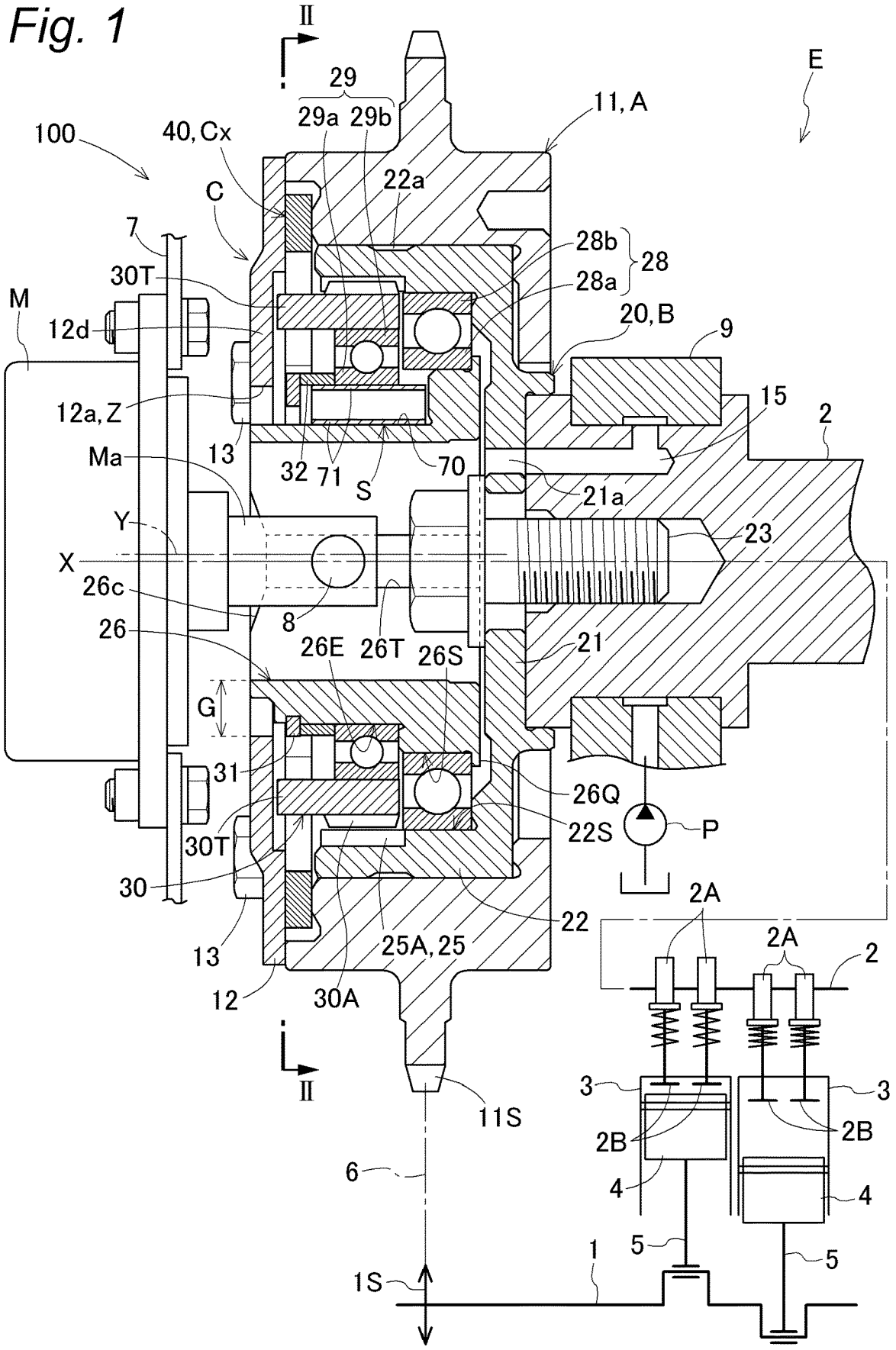
FIG. 1 is a cross-sectional view of a valve opening and closing timing control device.

As illustrated in FIG. 1, the valve opening and closing timing control device 100 according to the present embodiment includes the drive-side rotating body A, a driven-side rotating body B, and the phase adjustment mechanism C. The drive-side rotating body A rotates about the rotation axis X in synchronization with a crankshaft 1 of an engine E as an internal combustion engine. The driven-side rotating body B is disposed inside the drive-side rotating body A coaxially with a rotation axis X. The driven-side rotating body B rotates integrally with an intake camshaft 2 (an example of a camshaft) that opens and closes an intake valve 2B of the engine E (internal combustion engine). The phase adjustment mechanism C sets the relative rotational phase between the drive-side rotating body A and the driven-side rotating body B by the driving force of the phase control motor M (an example of an electric motor).

The valve opening and closing timing control device 100 is provided in the engine E of a vehicle such as a passenger car, and realizes control of the valve timing (opening and closing timing) of the intake valve 2B, the exhaust valve, or the intake/exhaust valve.

The engine E is configured as a four-cycle type in which a piston 4 is accommodated in each of a plurality of cylinders 3 formed in a cylinder block, and each piston 4 is connected to the crankshaft 1 by a connecting rod 5. A timing chain 6 (which may be a timing belt or the like) is wound across an output sprocket 1S of the crankshaft 1 of the engine E and a drive sprocket 11S of the drive-side rotating body A.

As a result, the entire valve opening and closing timing control device 100 rotates about the rotation axis X when the engine E is in operation. In addition, the valve opening and closing timing control device 100 is configured to be able to operate the phase adjustment mechanism C by the driving force of the phase control motor M (electric motor) and displace the driven-side rotating body B with respect to the drive-side rotating body A in the same direction as the rotation direction or the opposite direction.

The valve opening and closing timing control device 100 can set the relative rotational phase between the drive-side rotating body A and the driven-side rotating body B to the advance side and the retard side by the operation of the phase adjustment mechanism C, and sets the opening and closing timing (opening and closing timing) of the intake valve 2B by a cam portion 2A of the intake camshaft 2.

In the advance operation in which the relative rotational phase is set to the advance side, the intake timing of the intake valve 2B is advanced, and the intake compression ratio is increased. In the retard operation in which the relative rotational phase is set to the retard side, the intake timing of the intake valve 2B is delayed, and the intake compression ratio is reduced.

Valve Opening and Closing Timing Control Device

As illustrated in FIG. 1, the drive-side rotating body A includes an outer case 11 having a drive sprocket 11S formed on the outer periphery and a front plate 12 that are fastened with a plurality of fastening bolts 13. The outer case 11 has a bottomed cylindrical shape having an opening at the bottom. The front plate 12 is provided away from the intake camshaft 2 with respect to an eccentric member 26 in the direction along the rotation axis X.

Figure 2:
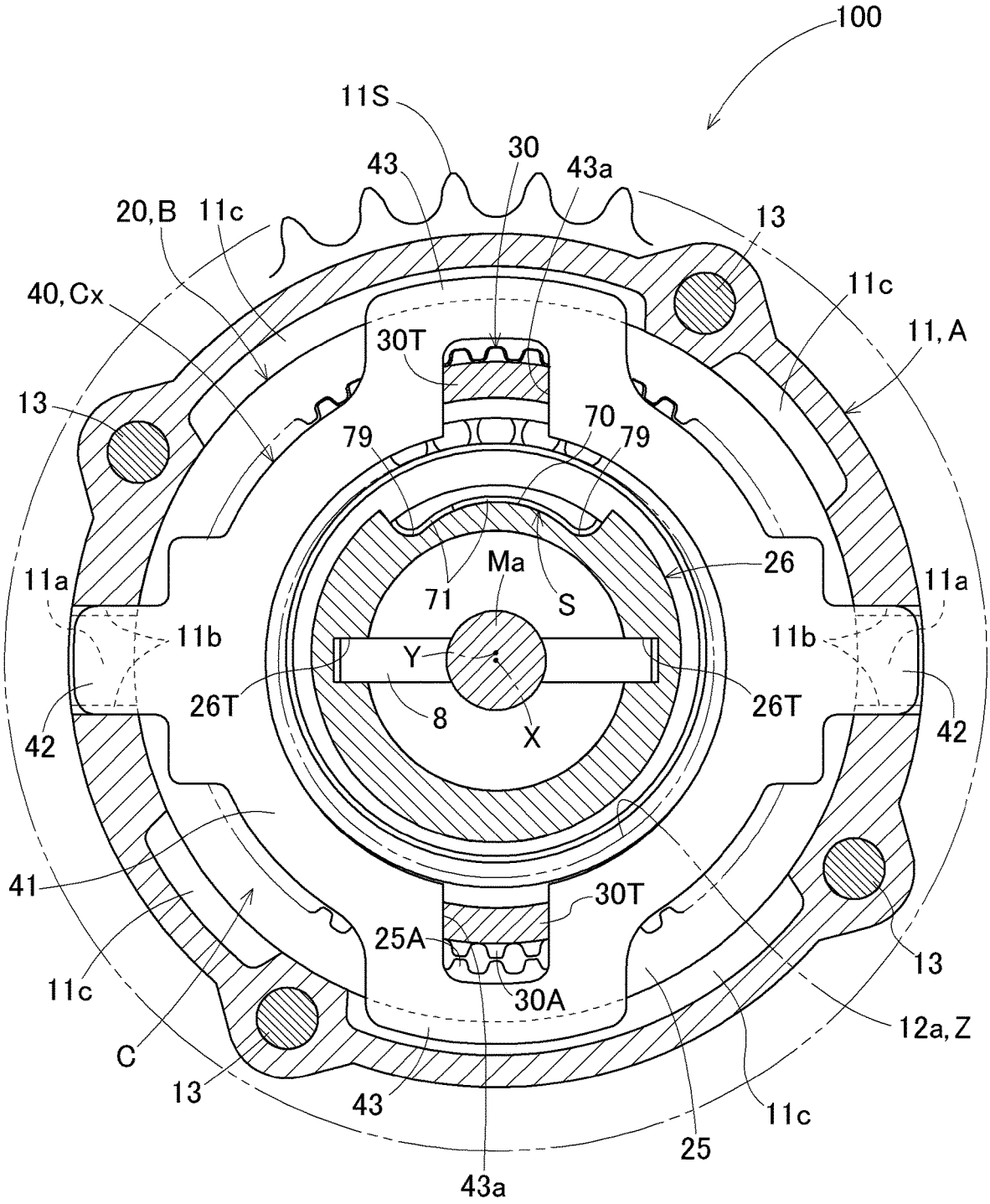
FIG. 2 is a sectional view taken along line II-II of FIG. 1.

As illustrated in FIGS. 1 and 2, an intermediate member 20 as the driven-side rotating body B and the phase adjustment mechanism C having a plurality of gears is accommodated in the internal space of the outer case 11. The phase adjustment mechanism C is linked to an Oldham's coupling Cx that reflects the phase change on the drive-side rotating body A and the driven-side rotating body B.

The intermediate member 20 constituting the driven-side rotating body B has a support wall portion 21 connected to the intake camshaft 2 in a posture orthogonal to the rotation axis X, and a cylindrical wall portion 22 having a cylindrical shape centered on the rotation axis X and protruding from an outer peripheral edge of the support wall portion 21 in a direction away from the intake camshaft 2, the intake camshaft and the cylindrical wall portion being integrally formed.

The intermediate member 20 is fitted in the outer case 11 so as to be relatively rotatable in a state where the outer face of the cylindrical wall portion 22 is in contact with the inner face of the outer case 11, and is fixed to the end of the intake camshaft 2 by a connecting bolt 23 inserted into the through hole at the center of the support wall portion 21. In the state of the connecting bolt 23 being fixed in this manner, the end of the cylindrical wall portion 22 on the outer side (away from the intake camshaft 2) is located inside the front plate 12.

As shown in FIGS. 1 and 2, a groove 22*a* is formed on the outer periphery of the cylindrical wall portion 22 over the entire circumference, and the groove 22*a* improves the retention of lubricating oil between the outer face of the cylindrical wall portion 22 and the inner face of the outer case 11. As a result, frictional force between the cylindrical wall portion 22 and the outer case 11 is reduced, and smooth relative rotation between the intermediate member 20 and the outer case 11 is realized.

As illustrated in FIG. 1, the phase control motor M is supported by the engine E by the support frame 7 so that an output shaft Ma of the phase control motor M is disposed coaxially with the rotation axis X. On the output shaft Ma of the phase control motor M, a pair of engagement pins 8 in a posture orthogonal to the rotation axis X is formed.

Phase Adjustment Mechanism

Figure 3:
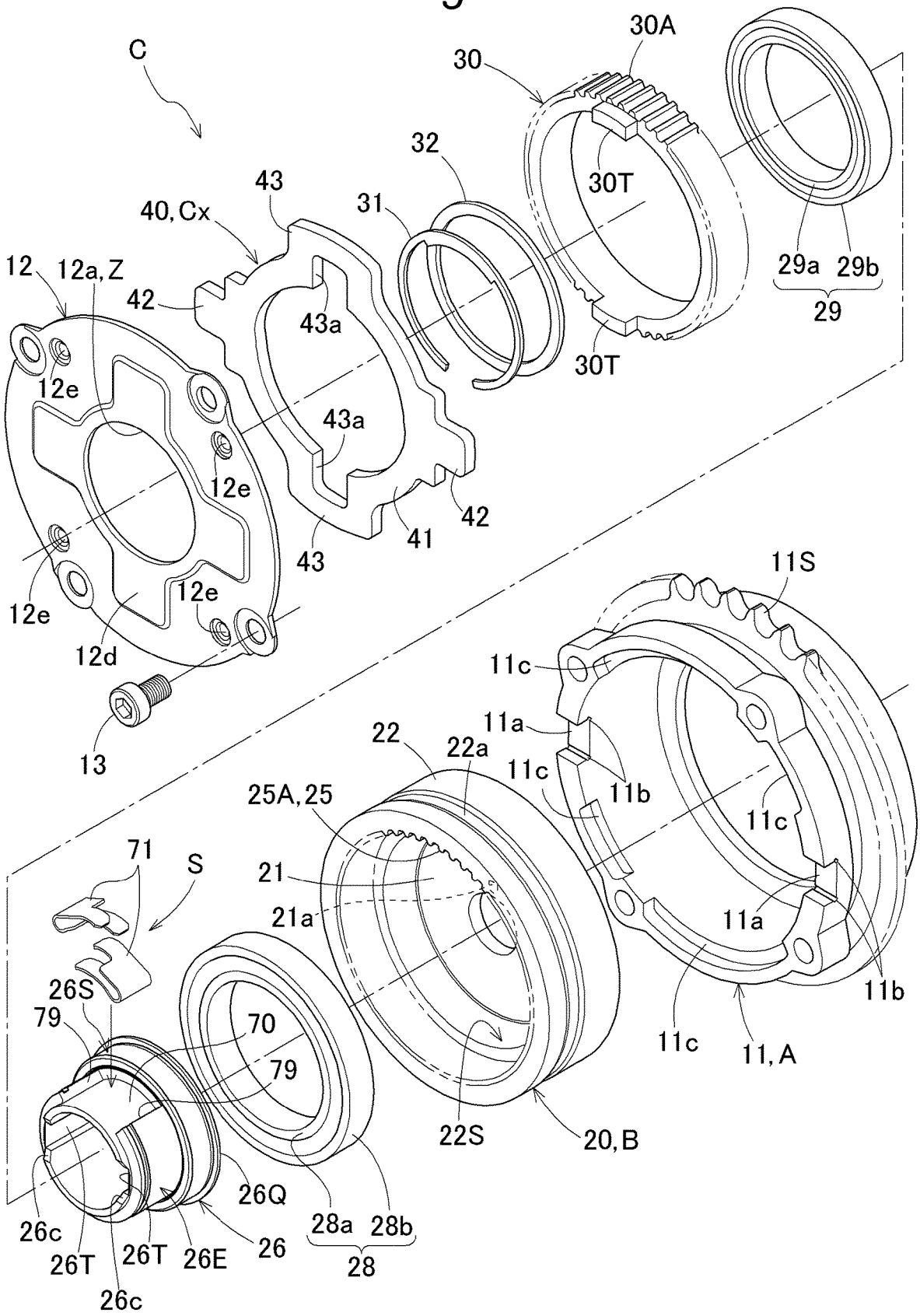
FIG. 3 is an exploded perspective view of the valve opening and closing timing control device.

As illustrated in FIGS. 1 to 3, the phase adjustment mechanism C includes the intermediate member 20, the output gear 25 formed on the inner peripheral face of the cylindrical wall portion 22 of the intermediate member 20, the eccentric member 26, an elastic member S, a first bearing 28, a second bearing 29, the input gear 30, a fixing ring 31, a ring-shaped spacer 32, and the Oldham's coupling Cx. A rolling bearing is used for the first bearing 28 and the second bearing 29, but a plain bearing can also be used. In the present embodiment, the first bearing 28 is a ball bearing having an inner ring 28*a* in contact with the outer peripheral face of the eccentric member 26 and an outer ring 28*b* in contact with the inner peripheral face of the intermediate member 20.

The second bearing 29 is a ball bearing having an inner ring 29*a* in contact with the outer peripheral face of the eccentric member 26 and an outer ring 29*b* in contact with the inner peripheral face of the input gear 30.

As illustrated in FIG. 1, in the inner circumference of the cylindrical wall portion 22 of the intermediate member 20, a support face 22S centered on the rotation axis X is formed on the inner side (position adjacent to the support wall portion 21) in the direction (hereinafter, it is described as an axial direction) along the rotation axis X, and an output gear 25 centered on the rotation axis X is integrally formed outside the support face 22S (away from the intake camshaft 2).

As illustrated in FIGS. 1 to 3, the eccentric member 26 has a cylindrical shape. The eccentric member 26 has a circumferential support face 26S, which is the outer peripheral face centered on the rotation axis X on the inner side (close to the intake camshaft 2) in the axial direction. The eccentric member 26 has a flange portion 26Q protruding further outward in the radial direction from the circumferential support face 26S further inside the circumferential support face 26S (close to the intake camshaft 2) in the axial direction.

The eccentric member 26 has an eccentric support face 26E, which is the outer peripheral face centered on an eccentric axis Y that is eccentric in a posture parallel to the rotation axis X on the outer side (away from the intake camshaft 2). Therefore, the eccentric member 26 has the flange portion 26Q, the circumferential support face 26S, and the eccentric support face 26E in this order from the side close to the intake camshaft 2 along the axial direction.

Since the direction along the eccentric axis Y is the same as the axial direction, hereinafter, the direction along the eccentric axis Y is also simply referred to as the axial direction.

As illustrated in FIGS. 1 and 3, the eccentric support face 26E has a first recess 70 that is recessed inward along the radial direction of the eccentric member 26. The bottom face of the first recess 70 has a pair of second recesses 79 and 79 recessed radially toward the axis of the eccentric member 26 at both ends of the eccentric member 26 in the circumferential direction. In the present embodiment, the first recesses 70 are symmetrical in the circumferential direction.

The second recesses 79 and 79 are formed at the respective ends of the first recess 70 in the circumferential direction of the eccentric member 26. The maximum depth of the bottom faces of the second recesses 79 and 79 in the radial direction of the eccentric member 26 is deeper than the depth of the bottom face of the first recess 70 near the circumferential center of the eccentric member 26. The face from the bottom face to the end portion of each of the second recesses 79 and 79 in the circumferential direction of the eccentric member 26 is formed in a shape along the curved shape of a spring member 71 described later.

The elastic member S is fitted into the first recess 70. The elastic member S includes a pair of spring members 71 and 71. In the present embodiment, the pair of spring members 71 and 71 has the same shape and the same size. The elastic member S applies a biasing force to the input gear 30 via the second bearing 29 so that part of the external tooth portion 30A of the input gear 30 meshes with part of the internal tooth portion 25A of the output gear 25.

As a result, it is possible to prevent the expansion of the backlash between the input gear 30 and the output gear 25 and to prevent the abnormal noise. Furthermore, the durability of the input gear 30 and the output gear 25 can be improved.

As illustrated in FIGS. 1 and 3, on the inner periphery of the eccentric member 26, a pair of engagement grooves 26T with which a pair of engagement pins 8 of the phase control motor M (see FIG. 1) can be engaged, respectively, are formed in a posture parallel to the rotation axis X.

As illustrated in FIG. 3, on the inner peripheral side of the opening end of the eccentric member 26 on the outer side (away from the intake camshaft 2), a tapered portion 26*c* (inclined portion) in which the diameter decreases toward the inner side (close to the intake camshaft 2) are formed on both side portions of the engagement groove 26T. When the pair of engagement pins 8 of the phase control motor M is engaged with the engagement grooves 26T of the eccentric member 26, the engagement pin 8 is guided to the engagement groove 26T by the tapered portion 26*c*, so that the engagement work between the phase control motor M and the eccentric member 26 is facilitated.

As illustrated in FIG. 1, the eccentric member 26 is rotatably supported by the intermediate member 20 about the rotation axis X by externally fitting the first bearing 28 to the circumferential support face 26S and fitting the first bearing 28 into the support face 22S of the cylindrical wall portion 22. As illustrated in FIG. 1, the input gear 30 is rotatably supported by the eccentric support face 26E of the eccentric member 26 via the second bearing 29 about the eccentric axis Y.

In the phase adjustment mechanism C, the number of teeth of the external tooth portion 30A of the input gear 30 is set to be smaller than the number of teeth of the internal tooth portion 25A of the output gear 25 by one tooth. Part of the external tooth portion 30A of the input gear 30 meshes with part of the internal tooth portion 25A of the output gear 25.

As illustrated in FIG. 1, the fixing ring 31 is supported by the outer periphery of the eccentric member 26 in a fitted state to prevent the second bearing 29 from coming off via the spacer 32.

As illustrated in FIG. 1, a gap is formed between the eccentric member 26 and the support wall portion 21 of the intermediate member 20.

Phase Adjustment Mechanism: Oldham's Coupling

As illustrated in FIGS. 1 to 3, the Oldham's coupling Cx includes a plate-shaped joint member 40 with a central annular portion 41, a pair of external engagement arms 42 protruding radially outward from the annular portion 41 along a first direction (left-right direction in FIG. 2), and an internal engagement arm 43 protruding radially outward from the annular portion 41 along a second direction (up-down direction in FIG. 2) orthogonal to the first direction that are integrally formed. Each of the pair of internal engagement arms 43 has an engagement recess 43*a* continuous with the opening of the annular portion 41.

Figure 5:
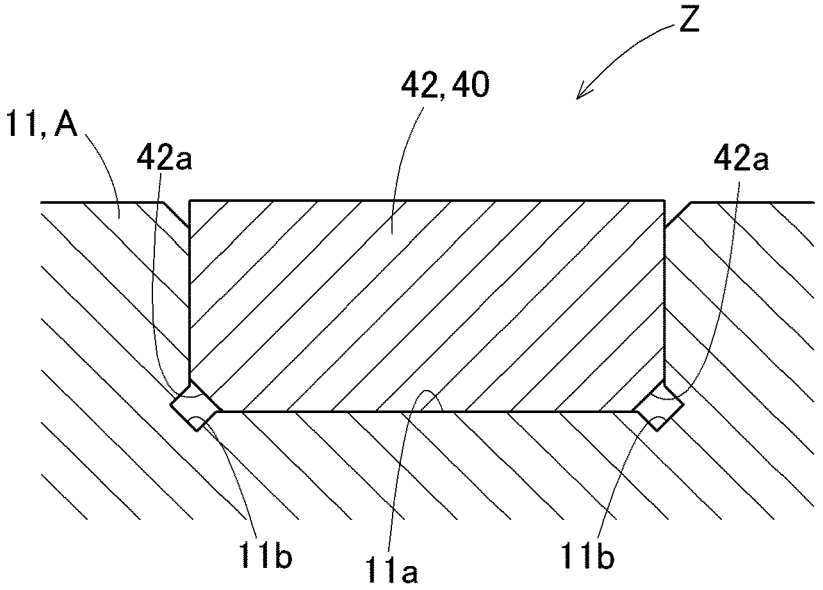
FIG. 5 is a cross-sectional view showing a discharge flow path.

In the outer case 11, a pair of guide grooves 11*a* extending in the radial direction about the rotation axis X from the internal space to the external space of the outer case 11 is formed in a penetrating groove shape at an opening edge portion that the front plate 12 contacts. The groove width of the guide groove 11*a* is set to be slightly wider than the width of the external engagement arm 42, and a cut portions 42*a* cut obliquely are formed at each of both circumferential ends of the external engagement arm 42 as illustrated in FIG. 5. A pair of discharge flow paths 11*b* is cut formed at the guide grooves 11*a* and the cut portions 42*a* at both ends of the external engagement arm 42 in the circumferential direction.

At the opening edge portion of the outer case 11, one or more pocket portions 11*c* whose inner periphery is cut along the circumferential direction are formed at a portion other than the guide groove 11*a*. The pocket portion 11*c* collects the foreign matter that moves to the outer peripheral side by receiving the centrifugal force due to the rotation of the drive-side rotating body A. FIGS. 2 and 3 illustrate a structure in which four pocket portions 11*c* are formed.

A pair of engagement protrusions 30T is integrally formed at an end face of the input gear 30, the face facing the front plate 12. The engagement width of the engagement protrusion 30T is set to be slightly narrower than the engagement width of the engagement recess 43*a* of the internal engagement arm 43.

With such a configuration, it is possible to cause the Oldham's coupling Cx to function by engaging the pair of external engagement arms 42 of the joint member 40 with the pair of guide grooves 11*a* of the outer case 11 and engaging the pair of engagement protrusions 30T of the input gear 30 with the engagement recesses 43*a* of the pair of internal engagement arms 43 of the joint member 40.

The joint member 40 can be displaced in the first direction (the left-right direction in FIG. 2) in which the external engagement arm 42 extends with respect to the outer case 11, and the input gear 30 can be displaced in the second direction (the up-down direction in FIG. 2) along the forming direction of the engagement recess 43*a* of the internal engagement arm 43 with respect to the joint member 40.

As illustrated in FIGS. 1 and 3, the spacer 32 makes the distance of the gap in which the second bearing 29 can move in the axial direction equal to or less than a predetermined set value. Since the spacer 32 is provided between the Oldham's coupling Cx (joint member 40) and the second bearing 29, the movement of the second bearing 29 in the axial direction is limited to a distance equal to or less than a predetermined set value.

On a face, of the front plate 12, facing the input gear 30, a recess 12*d* recessed toward the outside (away from the intake camshaft 2) is formed. The recess 12*d* is provided to face the opening portion of the joint member 40 in the front plate 12, and the recess 12*d* is formed to be slightly wider than the opening portion of the joint member 40. Accordingly, contact between the engagement protrusion 30T of the input gear 30 and the front plate 12 can be prevented.

Arrangement of Respective Components of Valve Opening and Closing Timing Control Device In the valve opening and closing timing control device 100 in the assembled state, as illustrated in FIG. 1, the support wall portion 21 of the intermediate member 20 is connected to the end of the intake camshaft 2 by the connecting bolt 23, and these components rotate integrally. The eccentric member 26 is supported by the intermediate member 20 using the first bearing 28 so as to be relatively rotatable about the rotation axis X. As illustrated in FIG. 1, the input gear 30 is supported by the eccentric support face 26E of the eccentric member 26 via the second bearing 29, and part of the external tooth portion 30A of the input gear 30 meshes with part of the internal tooth portion 25A of the output gear 25.

Further, as illustrated in FIG. 2, the external engagement arm 42 of the Oldham's coupling Cx is engaged with the pair of guide grooves 11*a* of the outer case 11, and the engagement protrusion 30T of the input gear 30 is engaged with the engagement recess 43*a* of the internal engagement arm 43 of the Oldham's coupling Cx. As illustrated in FIG. 1, since the front plate 12 is disposed outside the joint member 40 of the Oldham's coupling Cx, the joint member 40 is movable in a direction orthogonal to the rotation axis X in a state of being in contact with the inner face of the front plate 12. With this arrangement, the Oldham's coupling Cx is disposed outside both the first bearing 28 and the second bearing 29 (away from the intake camshaft 2) and inside the front plate 12 (close to the intake camshaft 2).

As illustrated in FIG. 1, the pair of engagement pins 8 formed on the output shaft Ma of the phase control motor M is engaged with the engagement grooves 26T of the eccentric member 26.

Mode of Operation of Phase Adjustment Mechanism

Figure 7:
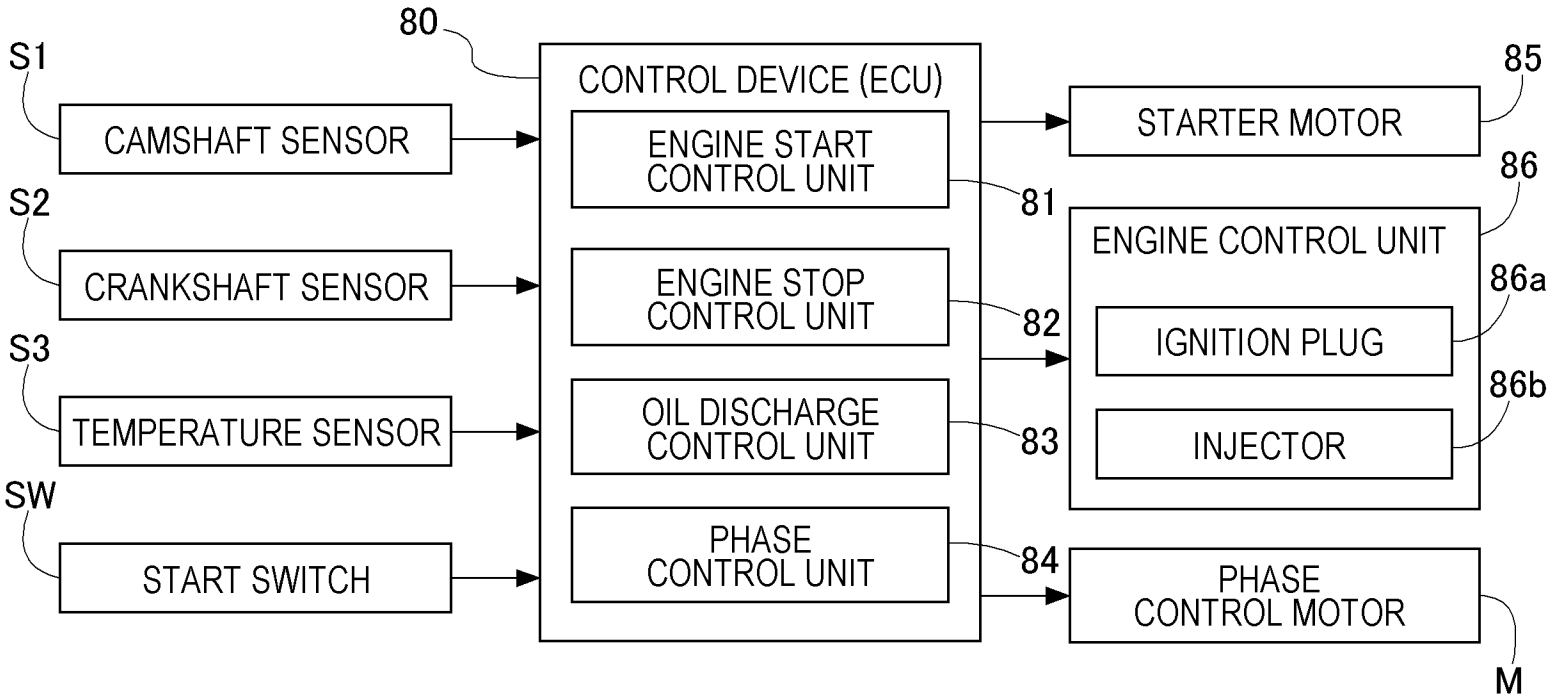
FIG. 7 is a block circuit diagram of a control configuration.

The phase control motor M is controlled by a control device 80 illustrated in FIG. 7. The control device 80 receives detection signals of a camshaft sensor S1 and a crankshaft sensor S2 that detect rotation angles of the crankshaft 1 and the intake camshaft 2.

The control device 80 maintains the relative rotational phase by driving the phase control motor M at a speed equal to the rotation speed of the intake camshaft 2 when the engine E is in operation. On the other hand, the advance operation is performed by reducing the rotation speed of the phase control motor M to be lower than the rotation speed of the intake camshaft 2, and the retard operation is performed by increasing the rotation speed. As described above, the intake compression ratio is increased by the advance operation, and the intake compression ratio is reduced by the retard operation.

The control device 80 is configured to perform oil discharge control for discharging lubricating oil inside the valve opening and closing timing control device 100 immediately after the engine E is stopped. Details of this oil discharge control will be described later.

When the phase control motor M rotates at a speed equal to that of the outer case 11 (equal to that of the intake camshaft 2), the position of the meshing portion of the external tooth portion 30A of the input gear 30 with respect to the internal tooth portion 25A of the output gear 25 does not change, so that the relative rotational phase of the driven-side rotating body B with respect to the drive-side rotating body A is maintained.

On the other hand, by driving and rotating the output shaft Ma of the phase control motor M at a speed higher or lower than the rotation speed of the outer case 11, the eccentric axis Y revolves around the rotation axis X in the phase adjustment mechanism C. Due to this revolution, the position of the meshing portion of the external tooth portion 30A of the input gear 30 with respect to the internal tooth portion 25A of the output gear 25 is displaced along the inner circumference of the output gear 25, and a rotational force acts between the input gear 30 and the output gear 25. That is, a rotational force about the rotation axis X acts on the output gear 25, and a rotational force to rotate about the eccentric axis Y acts on the input gear 30.

As described above, since the engagement protrusion 30T of the input gear 30 is engaged with the engagement recess 43*a* of the internal engagement arm 43 of the joint member 40, the input gear does not rotate with respect to the outer case 11, and the rotational force acts on the output gear 25. By the action of the rotational force, the intermediate member 20 together with the output gear 25 rotates about the rotation axis X with respect to the outer case 11. As a result, the relative rotational phase between the drive-side rotating body A and the driven-side rotating body B are set, and the opening and closing timing by the intake camshaft 2 is set.

When the eccentric axis Y of the input gear 30 revolves about the rotation axis X, the joint member 40 of the Oldham's coupling Cx is displaced in the direction in which the external engagement arm 42 extends with respect to the outer case 11 along with the displacement of the input gear 30, and the input gear 30 is displaced in the direction in which the internal engagement arm 43 extends.

As described above, since the number of teeth of the external tooth portion 30A of the input gear 30 is set to be smaller than the number of teeth of the internal tooth portion 25A of the output gear 25 by one tooth, in a case where the eccentric axis Y of the input gear 30 revolves by one rotation around the rotation axis X, the output gear 25 rotates by one tooth, and large reduction is realized.

Lubrication of Phase Adjustment Mechanism

As illustrated in FIG. 1, the intake camshaft 2 has a lubricating oil passage 15 through which lubricating oil from an external oil pump P (an example of a lubricating oil supply unit) is supplied via an oil passage forming member 9. On part of a face of the support wall portion 21 of the intermediate member 20, the face contacting the intake camshaft 2, an oil supply passage 21*a* that guides lubricating oil flowing through the lubricating oil passage 15 is formed inside the eccentric member 26. That is, the support wall portion 21 has the oil supply passage 21*a* through which the lubricating oil can be supplied from the outside to the inside of the driven-side rotating body B.

As described above, a gap is formed between the eccentric member 26 and the support wall portion 21 of the intermediate member 20. The oil supply passage 21*a* communicates with this gap.

With this configuration, the lubricating oil supplied from the oil pump P (lubricating oil supply unit) is supplied from the lubricating oil passage 15 of the intake camshaft 2 to the internal space of the intermediate member 20 via the oil supply passage 21*a* of the support wall portion 21 of the intermediate member 20. Part of the lubricating oil supplied to the internal space of the intermediate member 20 flows through the internal space of the eccentric member 26, but part of the lubricating oil is supplied to the first bearing 28 through a gap between the eccentric member 26 and the support wall portion 21 of the intermediate member 20 by the centrifugal force to smoothly operate (slide) the first bearing 28.

The lubricating oil supplied to the first bearing 28 is then supplied to the adjacent second bearing 29, and is also supplied between the internal tooth portion 25A of the output gear 25 and the external tooth portion 30A of the input gear 30, which are disposed on the outer periphery of the second bearing 29 and biased by the elastic member S, to smoothly operate (slide) these portions (particularly, the meshing portion).

The lubricating oil supplied to the second bearing 29 and between the internal tooth portion 25A of the output gear 25 and the external tooth portion 30A of the input gear 30 is further supplied to the joint member 40. The lubricating oil supplied to the joint member 40 is supplied between the front plate 12 and the joint member 40, and is supplied to a gap between the external engagement arm 42 of the joint member 40 and the guide groove 11*a* of the outer case 11. As a result, the joint member 40 is operated smoothly.

As described above, the guide groove 11*a* has a pair of discharge flow paths 11*b* (see FIGS. 2 and 3). Therefore, the lubricating oil supplied to the joint member 40 is discharged to the outside from the gap between the external engagement arm 42 of the joint member 40 and the guide groove 11*a* of the outer case 11. In addition, since the guide groove 11*a* has the discharge flow path 11*b*, the lubricating oil inside can be discharged from the discharge flow path 11*b* by the centrifugal force when the engine E is started.

As illustrated in FIGS. 1 and 3, the front plate 12 has a circular opening 12*a* centered on the rotation axis X at the center. By making the opening diameter of the opening 12*a* larger than the inner diameter of the eccentric member 26, a step G is formed between the opening edge of the opening 12*a* of the front plate 12 and the inner periphery of the eccentric member 26. The step G is set to the minimum within a range in which the eccentric member 26 does not contact the front plate 12 when rotating.

With this step G, when the engine E stops, the lubricating oil in the internal space of the eccentric member 26 is discharged from the opening 12*a* of the front plate 12, and the amount of the lubricating oil remaining inside can be reduced.

As described above, in the valve opening and closing timing control device 100, the lubricating oil supplied to the inside of the driven-side rotating body B can be discharged from the guide groove 11*a* of the outer case 11 and the opening 12*a* of the front plate 12.

Figure 4:
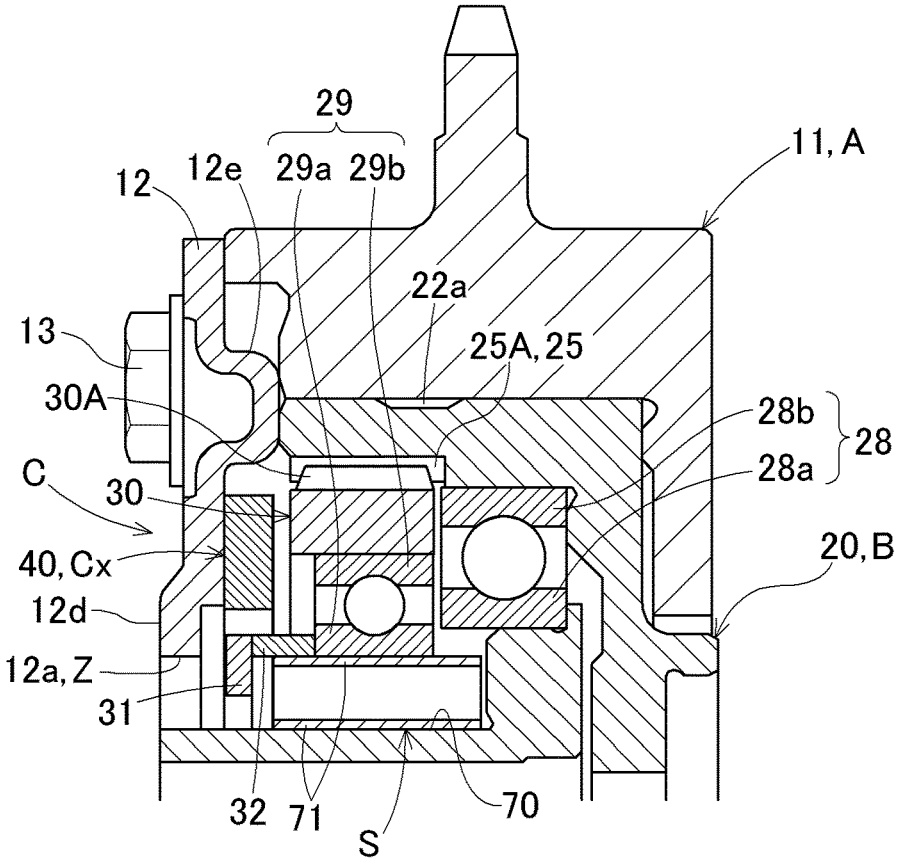
FIG. 4 is a cross-sectional view illustrating a protrusion of the front plate.

In the present embodiment, as illustrated in FIGS. 3 and 4, four protrusions 12*e* protruding inward (close to the intake camshaft 2) are formed along the circumferential direction of the front plate 12 on the face, of the front plate 12, facing the intermediate member 20. As illustrated in FIG. 4, the protrusion 12*e* is provided so as to face a boundary portion between the inner peripheral face of the outer case 11 and the outer peripheral face of the intermediate member 20 along the axial direction. As a result, the flow of the lubricating oil discharged from between the outer case 11 and the intermediate member 20 can be made different from the flow of the lubricating oil discharged from between the outer case 11 and the intermediate member 20 in the portion where the protrusion 12*e* is not provided, and the lubricating oil in the outer case 11 can be caused to flow.

Here, when the outer case 11 is rotating as described above, the lubricating oil is supplied from the oil supply passage 21*a* to the inside of the intermediate member 20. The valve opening and closing timing control device 100 is configured to have an oil reservoir structure Z that reduces the discharge amount of the lubricating oil discharged from the inside of the outer case 11 with respect to the supply amount of the lubricating oil supplied from the oil supply passage 21*a* to the inside of the intermediate member 20 during the synchronous rotation. Hereinafter, the oil reservoir structure Z will be described.

As described above, the external engagement arm 42 of the joint member 40 is engaged with the guide groove 11*a* of the outer case 11. The guide groove 11*a* is configured to be supplied with lubricating oil in order to enhance lubricity with the external engagement arm 42. However, since the lubricating oil having entered the guide groove 11*a* is discharged to the outside of the outer case 11 structurally, in the present embodiment, the amount of the lubricating oil discharged from the guide groove 11*a* is limited to a predetermined amount or less.

Specifically, the lubricating oil in the guide groove 11*a* flows through a pair of discharge flow paths 11*b* cut formed from the inside to the outside of the outer case 11 in each of the pair of guide grooves 11*a* as illustrated in FIG. 5. In the present embodiment, the oil reservoir structure Z is configured so that the amount of lubricating oil discharged from the pair of discharge flow paths 11*b* is smaller than the amount of lubricating oil flowing through the oil supply passage 21*a* when the outer case 11 rotates. Accordingly, the lubricating oil supplied to the inside of the outer case 11 has a lubricating function in the guide groove 11*a* and is hardly discharged.

Further, as illustrated in FIGS. 1 and 2, one side of the eccentric member 26 in the axial direction is inserted into the opening 12*a* which is an opening at a radially central portion of the front plate 12. In the present embodiment, the front plate 12 is opened to the position of the inserted radially outer end in a state where in the eccentric member 26, the difference of the eccentric axis Y with respect to the rotation axis X is the largest with the rotation axis X as the center.

In other words, the front plate 12 closes the opening portion of the outer case 11 to the position of the inserted radially outer end in the state where in the eccentric member 26, the difference of the eccentric axis Y with respect to the rotation axis X is the largest with the rotation axis X as the center. That is, as described above, the eccentric axis Y is eccentric with respect to the rotation axis X, and the eccentric axis Y revolves around the rotation axis X. Therefore, the portion, inserted through the front plate 12, of the eccentric member 26 rotates about the rotation axis X with a radius obtained by adding the amount of eccentricity of the eccentric axis Y with respect to the rotation axis X to half of the outer diameter of the portion, inserted through the front plate 12, of the eccentric member 26 as the rotation radius.

The opening 12*a* is configured so that a portion, inserted into the front plate 12, of the eccentric member 26 has an inner radius that is a sum of a half of an outer diameter of the portion, inserted into the front plate 12, of the eccentric member 26 with respect to the rotation axis X and an amount of eccentricity of the eccentric axis Y with respect to the rotation axis X so as not to come into contact with the front plate 12 when the eccentric member 26 rotates. In addition, the inner radius of the opening 12*a* is smaller than the inner radius of the joint member 40, the joint member 40 is covered by the front plate 12, and the joint member 40 cannot be visually recognized from the outside. As a result, the lubricating oil can be configured to be accumulated from the inner peripheral face to the opening 12*a* of the outer case 11 during operation of the engine E. Such a configuration of the opening 12*a* also corresponds to the oil reservoir structure Z described above.

Figure 6:
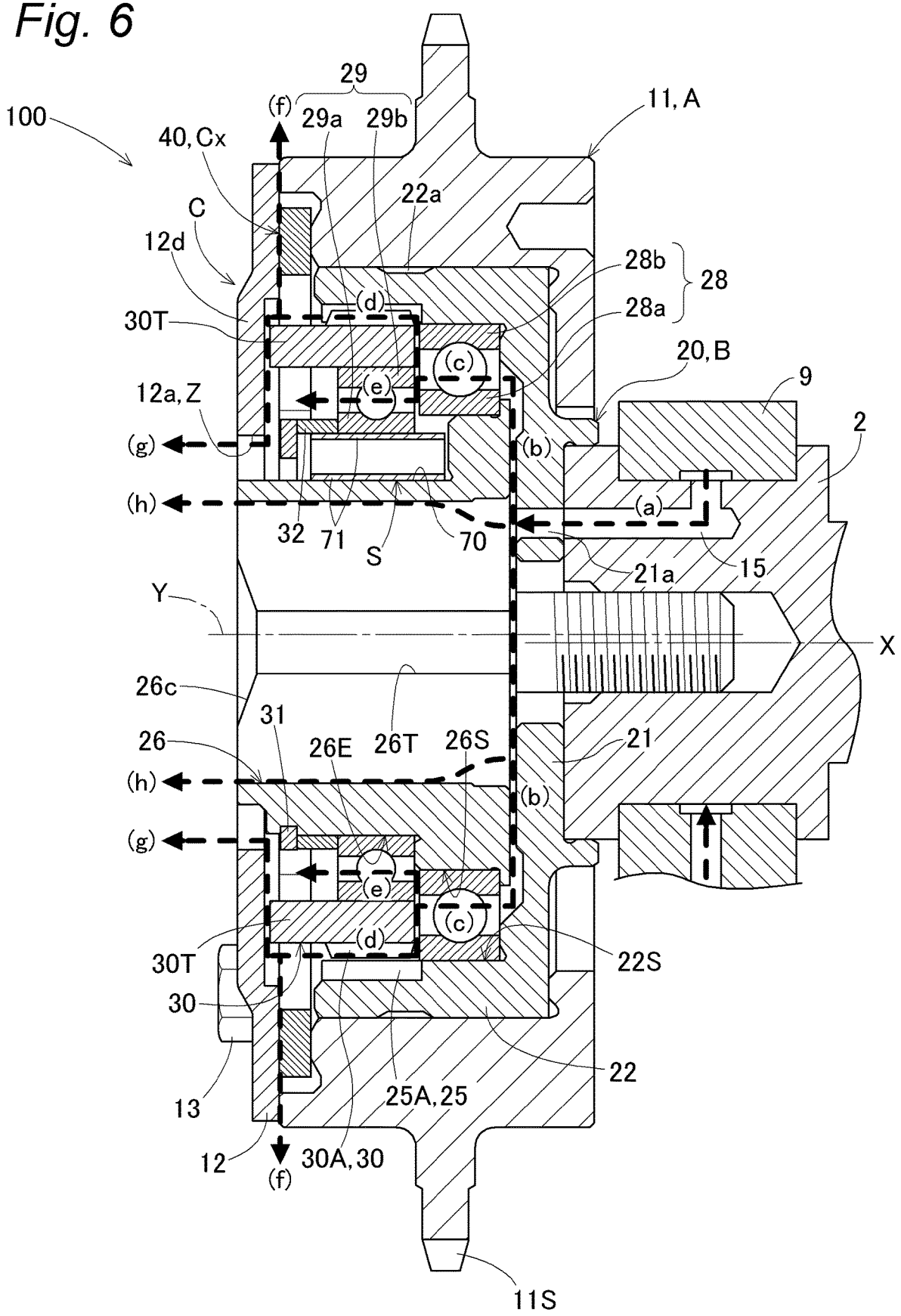
FIG. 6 is a cross-sectional view illustrating a flow of lubricating oil.

FIG. 6 illustrates a flow form of the lubricating oil in the valve opening and closing timing control device 100. In the valve opening and closing timing control device 100, the lubricating oil is supplied from the oil pump P to the oil supply passage 21*a* via the lubricating oil passage 15 (a). When the outer case 11 is rotating, the lubricating oil supplied from the oil supply passage 21*a* to the inside of the intermediate member 20 flows between the inner peripheral face of the intermediate member 20 and the outer peripheral face of the eccentric member 26 and to the inside of the eccentric member 26. That is, most of the lubricating oil supplied to the oil supply passage 21*a* flows between the eccentric member 26 and the support wall portion 21 of the intermediate member 20 by the centrifugal force, and flows toward the first bearing 28 by the centrifugal force (b). Part of the lubricating oil also flows (drops) to the central portion (radial central portion) of the eccentric member 26 (h).

The lubricating oil flowing through the first bearing 28 flows between the inner ring 28*a* and the outer ring 28*b* (c), and is supplied to (d) between the intermediate member 20 and the input gear 30 and to the second bearing 29 (e). The lubricating oil flowing between the intermediate member 20 and the input gear 30 and the lubricating oil supplied to the second bearing 29 and flowing between the inner ring 29*a* and the outer ring 29*b* are discharged to the outside of the outer case 11 through the gap between the front plate 12 and the outer case 11 (f), but most of the lubricating oil is stored inside the outer case 11.

When the second bearing 29 is viewed in the direction along the rotation axis X, the front plate 12 covers a region where the lubricating oil flows between the inner peripheral face of the intermediate member 20 and the outer peripheral face of the eccentric member 26. That is, the inner peripheral face of the opening 12*a* is provided at a position closer to the rotation axis X than a portion (d) between the intermediate member 20 and the input gear 30 described above and the path (e) supplied to the second bearing 29. As a result, the lubricating oil is accumulated in the outer case 11 from the inner peripheral face of the outer case 11 by the centrifugal force, and the lubricating oil is discharged from the opening 12*a* when reaching the opening 12*a* (g).

The pair of discharge flow paths 11*b* is configured so that the discharge amount of the lubricating oil from the pair of discharge flow paths 11*b* is smaller than the discharge amount of the lubricating oil flowing between the inner peripheral face of the intermediate member 20 and the outer peripheral face of the eccentric member 26. As a result, the flow rate in (a) of FIG. 6 is the sum of the flow rate in (c) and the flow rate in (h), and the flow rate in (f) is smaller than the flow rate in (c), and the lubricating oil can be stored in the outer case 11 until the lubricating oil flows out along (g). That is, the lubricating oil flowing in (b) flows along (c), (d), and (e), is stored in the outer case 11 by the centrifugal force, and is discharged along (g) when the liquid level reaches the opening 12*a*. At this time, the flow rate in (b) is the sum of the flow rate in (f) and the flow rate in (g). That is, the oil amount of the lubricating oil discharged from the discharge flow path 11*b* is configured to be smaller than the oil amount obtained by subtracting the oil amount of the lubricating oil flowing through the inside of the eccentric member 26 from the oil amount of the lubricating oil flowing through the oil supply passage 21*a*.

As a result, since the lubricating oil can be stored inside during the driving of the valve opening and closing timing control device 100, it is possible to reduce the loudness of the sound caused by the contact or collision of respective components by the damping effect of the oil (lubricating oil). Therefore, noise and vibration generated from the valve opening and closing timing control device 100 can be reduced. When the valve opening and closing timing control device 100 is not operated, the lubricating oil can be discharged from the opening 12*a* and the gap between the front plate 12 and the outer case 11. As described above, since the lubricating oil can be discharged, it is possible to suppress a decrease in the starting speed of the engine E (deterioration in starting performance of the engine E) due to, for example, viscosity of the lubricating oil at a low temperature.

Control Configuration

FIG. 7 illustrates a control device 80 that functions as an engine control unit (ECU) for controlling the phase of the valve opening and closing timing control device 100. The control device 80 includes an engine start control unit 81 configured as software, an engine stop control unit 82, an oil discharge control unit 83, and a phase control unit 84.

As partially described above, the control device 80 receives signals from the camshaft sensor S1, the crankshaft sensor S2, a temperature sensor S3, and a start switch SW, and outputs control signals to a starter motor 85, an engine control unit 86, and the phase control motor M.

The camshaft sensor S1 measures a rotation angle of the intake camshaft 2. The crankshaft sensor S2 measures a rotation angle of the crankshaft 1. The temperature sensor S3 measures the outside air temperature. The start switch SW starts the engine E by an artificial ON operation and stops the engine E by an artificial OFF operation.

The camshaft sensor S1 and the crankshaft sensor S2 are pickup-type sensors capable of acquiring a rotation angle from a reference rotational attitude as a count value by a pulse signal. With such a configuration, the phase control unit 84 acquires the relative rotational phase between the drive-side rotating body A and the driven-side rotating body B from the relative relationship between the count values of the pulse signals in the camshaft sensor S1 and the crankshaft sensor S2.

The starter motor 85 is driven in accordance with the ON operation of the start switch SW to drive and rotate the crankshaft 1. The engine control unit 86 controls a plurality of ignition plugs 86*a* that ignite the air-fuel mixture in the combustion chamber of the engine E and a plurality of injectors 86*b* that inject fuel into the combustion chamber of the engine E.

The engine start control unit 81 drives the starter motor 85 based on the ON operation of the start switch SW, controls the valve opening and closing timing control device 100 so as to set the opening and closing timing of the intake valve 2B to a timing suitable for combustion, and injects fuel into the combustion chamber by the injector 86*b* after the crankshaft 1 reaches a startable rotation speed, and ignites by the ignition plug 86*a* to realize the start of the engine E.

The engine start control unit 81 drives the oil pump P in accordance with the control of starting the engine E. The oil pump P is assumed to be configured to transmit the rotational force of the crankshaft 1, for example, but may be driven by an electric motor.

The engine stop control unit 82 stops the injection of fuel by the injector 86*b* based on the OFF operation of the start switch SW in a situation where the engine E operates, and stops the engine E. Further, the oil pump P stops as the engine E stops.

The oil discharge control unit 83 measures the outside air temperature by the temperature sensor S3 at the time when the engine E is stopped by the control of the engine stop control unit 82, and when it is determined that the outside air temperature is 0° C. or less (an example of a predetermined value or less), alternately displaces the relative rotational phase of the valve opening and closing timing control device 100 to the advance side and the retard side by the control of the phase control motor M, and discharges the lubricating oil in the valve opening and closing timing control device 100. A control mode of the oil discharge control unit 83 will be described later. The oil discharge control unit 83 performs the oil discharge control when the outside air temperature is equal to or lower than 0° C. as a predetermined value, but the predetermined value is not limited to 0° C., and any value can be set.

The phase control unit 84 calculates the relative rotational phase of the valve opening and closing timing control device 100 by acquiring the signals of the camshaft sensor S1 and the crankshaft sensor S2, and controls the phase control motor M so as to set the relative rotational phase thus calculated to the target relative rotational phase.

As described above, since the lubricating oil is supplied to the inside of the valve opening and closing timing control device 100, it is also assumed that the viscosity of the lubricating oil inside increases as in a case where the outside air temperature decreases after the engine E is stopped. When the viscosity of the lubricating oil increases in this manner, it is assumed that there is an inconvenience that it takes time to set the relative rotational phase of the valve opening and closing timing control device 100 at the time of starting the engine E, and control of discharging the lubricating oil by the oil discharge control unit 83 in association with the control to stop the engine E is performed.

Control Mode

Figure 8:
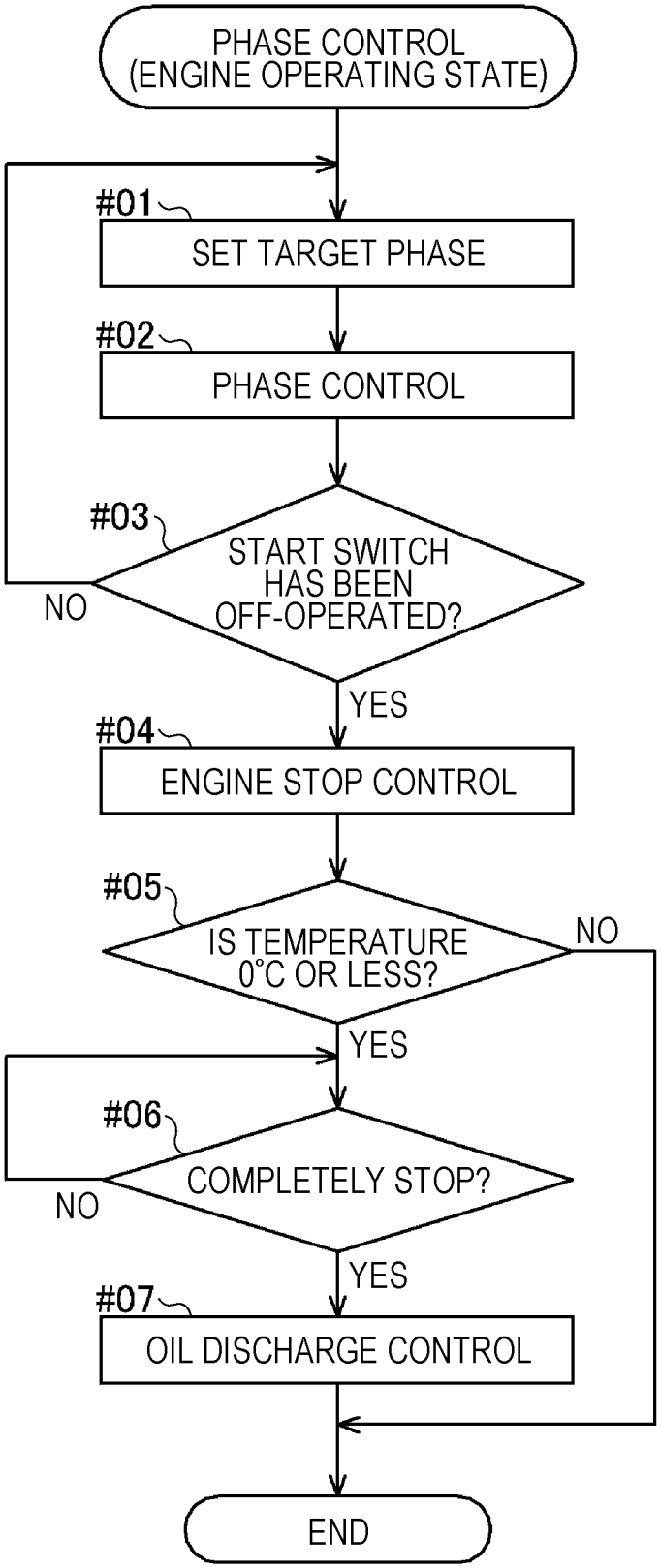
FIG. 8 is a flowchart of phase control.

As illustrated in the flowchart of FIG. 8, when the engine E is in the operating state, the phase control unit 84 sets a target phase and performs phase control (steps #01 to #02).

The setting of the target phase is set by the control device 80 that has received a command from a host ECU based on the situation such as the depression amount of the accelerator pedal, the load acting on the engine E, and the traveling speed of the vehicle. This target phase corresponds to the valve timing of the intake valve 2B. With such a setting, the phase control unit 84 performs feedback control so that the relative rotational phase acquired from the signals of camshaft sensor S1 and crankshaft sensor S2 reaches the target phase.

The phase control unit 84 continues the control until the start switch SW is turned OFF (step #03). When the start switch SW is turned OFF (Yes in step #03), the engine stop control unit 82 performs control to stop the engine E (step #04).

After the control for stopping the engine E is executed in this manner, after it is confirmed that the engine E has completely stopped (step #06), such as when it is determined that the outside air temperature measured by the temperature sensor S3 is 0° C. or lower (Yes in step #05), when the number of rotations Q (see FIG. 9) of the crankshaft 1 per unit time reaches zero ("0"), or when the hydraulic pressure of the oil pump driven by the engine E reaches a predetermined set value or lower, the oil discharge control for alternately displacing the valve opening and closing timing control device 100 between the most advanced phase AD and the most retarded phase RE is performed (step #07), and then the phase control is terminated.

When the outside air temperature measured by the temperature sensor S3 is higher than 0° C. in step #05 (No in step #05), the control is ended without performing the oil discharge control.

Figure 9:
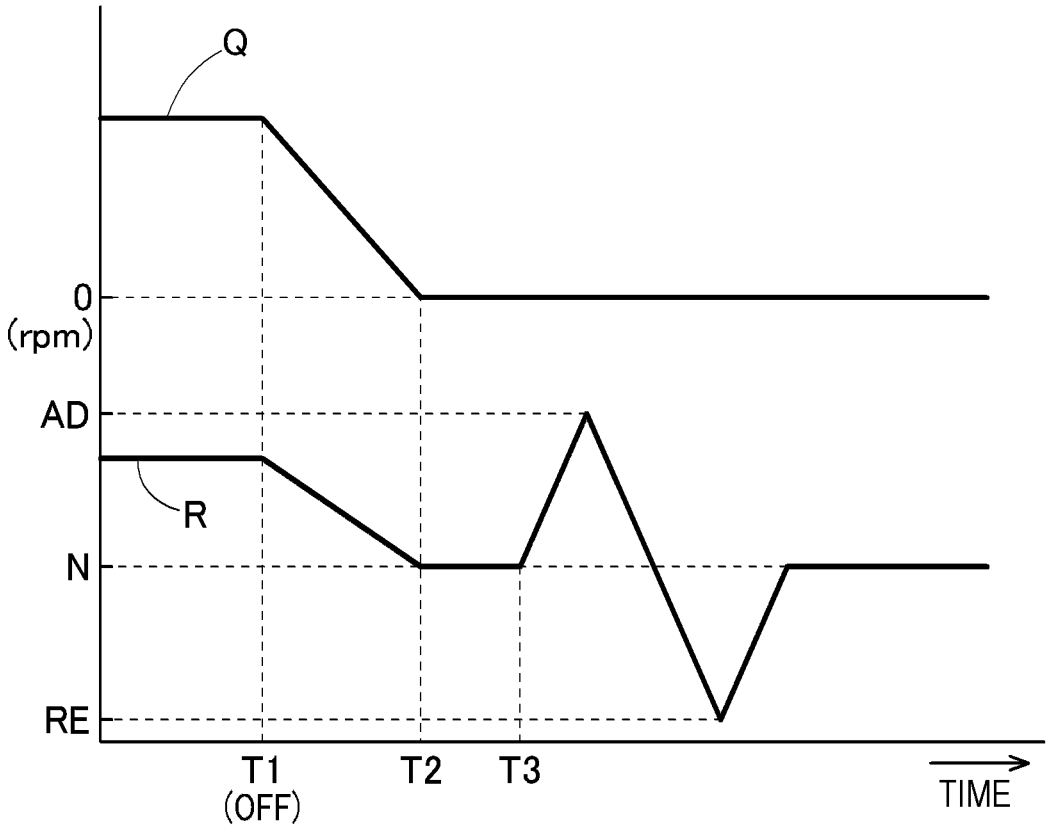
FIG. 9 is a chart illustrating the number of rotations of the crankshaft and a relative rotational phase of the valve opening and closing timing control device.

FIG. 9 shows a chart from the control for stopping the engine E to the oil discharge control (#07 step). In the chart illustrated in FIG. 9, the number of rotations Q of the crankshaft 1 of the engine E is illustrated in the upper stage, and the relative rotational phase R of the valve opening and closing timing control device 100 is illustrated in the lower stage.

As illustrated in FIG. 9, the most advanced phase AD, the intermediate phase N, and the most retarded phase RE are illustrated. T1 in FIG. 9 indicates a timing (stop start timing T1) at which stop control of the engine E is started, T2 indicates a timing (complete stop timing T2) at which the engine E is completely stopped, and T3 indicates a timing (oil discharge control start timing T3) at which oil discharge control is started.

As illustrated in FIG. 9, the engine stop control in step #04 is started in accordance with the OFF operation of the start switch SW at the stop start timing T1, the number of rotations Q of the crankshaft 1 decreases, and the number of rotations Q decreases to zero at the complete stop timing T2.

At the oil discharge control start timing T3 after a set time has elapsed from the complete stop timing T2, the oil discharge control unit 83 drives the phase control motor M to perform control to displace the relative rotational phase to the most advanced phase AD, then to the most retarded phase RE, and then to the intermediate phase N to maintain the relative rotational phase.

In the oil discharge control (step #07), the timing at which the relative rotational phase of the valve opening and closing timing control device 100 reaches the most advanced phase AD and the timing at which the relative rotational phase reaches the most retarded phase RE are determined, and the phase control motor M is controlled.

By performing such oil discharge control (#07 step), the lubricating oil remaining in the valve opening and closing timing control device 100 is discharged to the outside from the guide groove 11*a* of the outer case 11, and the lubricating oil is caused to flow from the engagement recess 43*a* of the joint member 40 to the opening 12*a* of the front plate 12 and is discharged to the outside.

Action and Effect of the Embodiment

The valve opening and closing timing control device 100 has an oil reservoir structure Z therein and is configured to enable discharge of lubricating oil when the engine E is stopped. However, since the configuration that enables the discharge of the lubricating oil in this manner is a configuration that discharges the lubricating oil inside the valve opening and closing timing control device 100 by the weight of the lubricating oil, for example, it has been considered that the lubricating oil remains in the oil reservoir structure Z.

On the other hand, as described in the embodiment, the oil discharge control unit 84 controls the phase control motor M to alternately change the relative rotational phase of the valve opening and closing timing control device 100 after the engine E is completely stopped by the stop control of the engine E. With the configuration of changing the relative rotational phase in this manner, it is possible to discharge the lubricating oil present at the engagement portion between the internal tooth portion 25A of the output gear 25 and the external tooth portion 30A of the input gear 30 constituting the phase adjustment mechanism C, or the lubricating oil present at the rotating portion between the inner periphery of the drive-side rotating body A and the outer periphery of the driven-side rotating body B or the like, or the sliding portion of the joint member 40 or the like.

This configuration makes it possible to discharge the lubricating oil from the regions such as the guide groove 11*a* of the outer case 11 and the opening 12*a* of the front plate 12 without changing the mechanical structure such as changing the shape of the valve opening and closing timing control device 100 or adding a special mechanism, and to satisfactorily discharge the lubricating oil remaining in the valve opening and closing timing control device 100.

As a result, for example, when the engine E of the vehicle stopped in the cold district is started, since the oil amount of the lubricating oil remaining in the valve opening and closing timing control device 100 is small, even when the temperature of the valve opening and closing timing control device 100 decreases to below the freezing point and the viscosity of the lubricating oil increases, even when the valve timing is required to be adjusted with the start of the engine E, this adjustment can be performed quickly.

Further, in this configuration, in the oil discharge control (step #07), the relative rotational phase of the valve opening and closing timing control device 100 is displaced between the most advanced phase AD and the most retarded phase RE. Therefore, the relative rotational phase is greatly changed, and the lubricating oil remaining in the internal space of the valve opening and closing timing control device 100 is caused to flow, and this flow force is also used to realize reliable oil discharge.

A configuration of a valve opening and closing timing control device according to the present disclosure includes a drive-side rotating body that rotates synchronously with a crankshaft of an internal combustion engine about a rotation axis, a driven-side rotating body that is disposed coaxially with the rotation axis and inside the drive-side rotating body, and rotates integrally with a camshaft for opening and closing a valve of the internal combustion engine, a phase adjustment mechanism that includes a plurality of gears for reducing a driving rotational force of an electric motor and sets a relative rotational phase between the drive-side rotating body and the driven-side rotating body, a lubricating oil supply unit that supplies lubricating oil to the phase adjustment mechanism from an outside, and an oil discharge control unit that performs oil discharge control of discharging lubricating oil by changing the relative rotational phase by driving the electric motor in accordance with stop control of stopping the internal combustion engine.

According to the present configuration, the oil discharge control unit changes the relative rotational phase in accordance with the stop control for stopping the internal combustion engine, so that the lubricating oil remaining inside can be discharged from, for example, the opening portion at the end of the drive-side rotating body or the gap between the driven-side rotating body and the plurality of gears constituting the phase adjustment mechanism. By actively discharging the lubricating oil remaining inside in this manner, even when the viscosity of the lubricating oil increases in a low-temperature environment, the operating speed of the phase adjustment mechanism is not reduced, and an excessive load does not act on the electric motor. Therefore, the valve opening and closing timing control device that can appropriately set the valve timing when starting the internal combustion engine at a low temperature has been configured.

Other Embodiments

The present disclosure may be configured as follows in addition to the above-described embodiment (those having the same functions as those in the embodiment are designated by the same number and reference numeral as those in the embodiment).

(a) In the oil discharge control (step #07) shown in FIG. 9, the operation of reciprocating the relative rotational phase of the valve opening and closing timing control device 100 between the most advanced phase AD and the most retarded phase RE is performed twice or more. By performing such control, it is possible to more reliably discharge oil.

(b) Regardless of the outside air temperature measured by the temperature sensor S3, the control mode is set so that the oil discharge control is always performed when the engine E is stopped. As a result, even when the outside air temperature greatly decreases after the engine E is stopped, the valve opening and closing timing control device 100 can be smoothly controlled at the time of starting the engine E.

Note that the configuration disclosed in the above-described embodiments (including the another embodiment, the same applies hereinafter) can be applied in combination with the configuration disclosed in other embodiments as long as there is no contradiction, and the embodiments disclosed in the present specification are an example, and the embodiments of the present disclosure are not limited thereto, and can be appropriately modified without departing from the object of the present disclosure.

In the above-described embodiment, the following configuration is conceived.

(1) A valve opening and closing timing control device including a drive-side rotating body A that rotates synchronously with a crankshaft 1 of an internal combustion engine (engine E) about a rotation axis X, a driven-side rotating body B that is disposed coaxially with the rotation axis and inside the drive-side rotating body A, and rotates integrally with a camshaft 2 for opening and closing a valve of the internal combustion engine (engine E), a phase adjustment mechanism C that includes a plurality of gears for reducing a driving rotational force of an electric motor (phase control motor M) and sets a relative rotational phase between the drive-side rotating body A and the driven-side rotating body B, a lubricating oil supply unit (oil pump P) that supplies lubricating oil to the phase adjustment mechanism C from an outside, and an oil discharge control unit 83 that performs oil discharge control of discharging lubricating oil by changing the relative rotational phase by driving the electric motor (phase control motor M) in accordance with stop control of stopping the internal combustion engine.

Accordingly, in accordance with the stop control for stopping the internal combustion engine (engine E), the oil discharge control unit 83 drives the electric motor (phase control motor M) to perform the oil discharge control for changing the relative rotational phase of the valve opening and closing timing control device 100, thereby being able to discharge the lubricating oil inside the valve opening and closing timing control device 100. Specifically, since the lubricating oil present in the engagement portion of the plurality of gears that reduces the driving rotational force of the electric motor (phase control motor M) is discharged, even when the viscosity of the lubricating oil increases as the temperature decreases, the operation speed of the phase adjustment mechanism C is not reduced, and an excessive load is not applied to the electric motor (phase control motor M).

(2) In the valve opening and closing timing control device of (1), the oil discharge control unit 83 preferably changes the relative rotational phase between the most retarded phase RE and the most advanced phase AD once or more.

According to this, the relative rotational phase of the valve opening and closing timing control device 100 is changed once or more between the most retarded phase RE, which is the limit on the retard side, and the most advanced phase AD, which is the limit on the advance side, so that it is possible to actively discharge the lubricating oil inside.

(3) In the valve opening and closing timing control device 100 of (1), the oil discharge control unit 83 preferably performs the oil discharge control after the number of rotations of the internal combustion engine (engine E) is zero or after the hydraulic pressure is equal to or less than a predetermined set value.

According to this, since the oil discharge control is performed in a state where the internal combustion engine (engine E) is completely stopped or after the hydraulic pressure of the lubricating oil or the like supplied from the hydraulic pump is equal to or less than the predetermined set value, for example, as compared with a case where the oil discharge control is performed in a situation where the internal combustion engine (engine E) rotates, the lubricating oil that does not flow inside the valve opening and closing timing control device 100 can be easily discharged by flowing down by its own weight.

(4) In the valve opening and closing timing control device 100 of (1), the oil discharge control unit 83 preferably performs the oil discharge control only when the outside air temperature is a predetermined value or less.

According to this, by performing the oil discharge control when it is assumed that the outside air temperature is low and the viscosity of the lubricating oil inside the valve opening and closing timing control device 100 increases, the valve timing can be easily set at the time of starting the internal combustion engine (engine E). On the other hand, since the oil discharge control is not performed when the outside air temperature is high, electric energy is not wastefully consumed.

The present disclosure can be used in a valve opening and closing timing control device.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve opening and closing timing control device comprising:

a drive-side rotating body that rotates synchronously with a crankshaft of an internal combustion engine about a rotation axis;

a driven-side rotating body that is disposed coaxially with the rotation axis and inside the drive-side rotating body, and rotates integrally with a camshaft for opening and closing a valve of the internal combustion engine;

a phase adjustment mechanism that includes a plurality of gears for reducing a driving rotational force of an electric motor and sets a relative rotational phase between the drive-side rotating body and the driven-side rotating body;

a lubricating oil supply unit that supplies lubricating oil to the phase adjustment mechanism from an outside; and an oil discharge control unit that performs oil discharge control of discharging lubricating oil by changing the relative rotational phase by driving the electric motor in response to a determination that the internal combustion engine has stopped in accordance with stop control of stopping the internal combustion engine.

2. The valve opening and closing timing control device according to claim 1, wherein the oil discharge control unit changes the relative rotational phase once or more between a most retarded phase and a most advanced phase.

3. The valve opening and closing timing control device according to claim 1, wherein the oil discharge control unit performs the oil discharge control after a number of rotations of the internal combustion engine is zero or after a hydraulic pressure is a predetermined set value or less.

4. The valve opening and closing timing control device according to claim 1, wherein the oil discharge control unit performs the oil discharge control only when an outside air temperature is equal to or lower than a predetermined value.

5. A valve opening and closing timing control device comprising:

a drive-side rotating body that rotates synchronously with a crankshaft of an internal combustion engine about a rotation axis;

a driven-side rotating body that is disposed coaxially with the rotation axis and inside the drive-side rotating body, and rotates integrally with a camshaft for opening and closing a valve of the internal combustion engine;

a phase adjustment mechanism that includes a plurality of gears for reducing a driving rotational force of an electric motor and sets a relative rotational phase between the drive-side rotating body and the driven-side rotating body;

a lubricating oil supply unit that supplies lubricating oil to the phase adjustment mechanism from an outside; and an oil discharge control unit that performs oil discharge control of discharging lubricating oil by changing the relative rotational phase by driving the electric motor in accordance with stop control of stopping the internal combustion engine, wherein the oil discharge control unit performs the oil discharge control only when an outside air temperature is equal to or lower than a predetermined value.

6. A valve opening and closing timing control device comprising:

a drive-side rotating body that rotates synchronously with a crankshaft of an internal combustion engine about a rotation axis;

a driven-side rotating body that is disposed coaxially with the rotation axis and inside the drive-side rotating body, and rotates integrally with a camshaft for opening and closing a valve of the internal combustion engine;

a phase adjustment mechanism that includes a plurality of gears for reducing a driving rotational force of an electric motor and sets a relative rotational phase between the drive-side rotating body and the driven-side rotating body;

a lubricating oil supply unit that supplies lubricating oil to the phase adjustment mechanism from an outside; and an oil discharge control unit that performs oil discharge control of discharging lubricating oil by changing the relative rotational phase by driving the electric motor in accordance with stop control of stopping the internal combustion engine, wherein the oil discharge control unit performs the oil discharge control in response to a determination that a hydraulic pressure is a predetermined set value or less.

* * * * *